US011069227B1

(12) United States Patent
Hubatka

(10) Patent No.: US 11,069,227 B1
(45) Date of Patent: Jul. 20, 2021

(54) FIREARM SYSTEM HAVING MONITORING CAPABILITIES

(71) Applicant: Heiko Hubatka, North Vancouver (CA)

(72) Inventor: Heiko Hubatka, North Vancouver (CA)

( * ) Notice: Subject to any disclaimer, the term of this patent is extended or adjusted under 35 U.S.C. 154(b) by 0 days.

(21) Appl. No.: 16/946,722

(22) Filed: Jul. 1, 2020

(51) Int. Cl.
*G08C 17/02* (2006.01)
*F41B 11/71* (2013.01)

(52) U.S. Cl.
CPC ..... *G08C 17/02* (2013.01); *F41B 11/71* (2013.01); *G08C 2200/00* (2013.01); *G08C 2201/10* (2013.01)

(58) Field of Classification Search
CPC ..... G08C 17/02; F41B 11/71
USPC ..... 340/539.1
See application file for complete search history.

(56) References Cited

U.S. PATENT DOCUMENTS 5,826,360 A * 10/1998 Herold ..... F41A 9/62 42/1.02
2011/0309975 A1* 12/2011 Chu ..... F41A 17/06 342/357.25
2016/0069629 A1* 3/2016 Seckman ..... F41A 9/62 42/1.02
2017/0051993 A1* 2/2017 Imbriano ..... F41A 19/01
2018/0238649 A1* 8/2018 Winiecki ..... F41C 33/029
2019/0195585 A1* 6/2019 Rensing ..... H04N 7/185
2019/0281259 A1* 9/2019 Palazzolo ..... H04L 9/0643

* cited by examiner

*Primary Examiner* — Kerri L McNally
(74) *Attorney, Agent, or Firm* — Orin Del Vecchio

(57) ABSTRACT

An airsoft firearm system configured to provide a plurality of operational parameters of the airsoft firearm during utilization thereof. The airsoft firearm system includes a communications module wherein the communications module is operable to wirelessly transmit operational parameter data to a remote computing device. A power supply and a power monitoring module are located in the firearm so as to provide the necessary power to operate the firearm and monitoring thereof. An ammunition counting module is present within the firearm wherein the ammunition counting module provides data on ammunition consumption rate and remaining ammunition. A safety module is present and is operably coupled to the power supply and is configured to provide control thereof. A position sensor is located on the firearm and is operable to detect the orientation of the firearm. An audio module is operably coupled to the communications module and is configured to broadcast sound effects.

14 Claims, 1 Drawing Sheet

FIREARM SYSTEM HAVING MONITORING CAPABILITIES

FIELD OF THE INVENTION

The present invention relates generally to firearms and accessories, more specifically but not by way of limitation, an airsoft firearm system that is configured to provide monitoring of various operational parameters such as but not limited to power source pressure and ammunition quantity.

BACKGROUND

As is known in the art airsoft guns are replica toy guns that are utilized in airsoft sports. These types of guns are a unique type of gun having a very low power and smooth bore barrel wherein the gun is designed to shoot non-metallic spherical projectiles typically manufactured from plastic. There are two primary categories of airsoft guns, which are based on their power systems. A first category is mechanical wherein the power system is a coil spring-loaded piston air pump that is either manually operated or operated via a battery powered component. The additional category of airsoft guns is the pneumatic category. This category utilizes a power system that operates on compressed gas such as but not limited to carbon dioxide and the power system provides a valve controlled release of the gas to provide operation of the firearm.

One problem with existing airsoft weapons is their inability to monitor operational parameters such as but not limited to power system monitoring. Airsoft guns are often utilized in tactical war games wherein participants engage in mock warfare. During these exercises the user may lose power or become depleted of ammunition because the conventional technology employed in airsoft weapons does not provide monitoring of these and other operational parameters.

It is intended within the scope of the present invention to provide an airsoft firearm system that includes components that are configured to provide monitoring of operational parameters such as but not limited to power source monitoring and ammunition quantity monitoring.

SUMMARY OF THE INVENTION

It is the object of the present invention to provide a firearm system that is configured to provide operational monitoring during use of the firearm wherein the preferred embodiment of the firearm is an airsoft gun.

Another object of the present invention is to provide an airsoft firearm system that is configured to provide information to a user wherein the present invention includes a communication module that is configured to transmit data to a cellular phone or other portable computing device.

A further object of the present invention is to provide a firearm system that is configured to provide operational monitoring during use of the firearm wherein the firearm further includes a pressure sensor operable to monitor the amount of propellant.

Still another object of the present invention is to provide an airsoft firearm system that is configured to provide information to a user wherein the present invention further includes a power monitor.

An additional object of the present invention is to provide a firearm system that is configured to provide operational monitoring during use of the firearm wherein the present invention further includes an ammunition counting module.

Yet a further object of the present invention is to provide an airsoft firearm system that is configured to provide information to a user wherein the firearm system includes a first location sensor and a second location sensor.

Another object of the present invention is to provide a firearm system that is configured to provide operational monitoring during use of the firearm wherein the present invention further includes an ammunition discharge module configured to provide data regarding the rate of ammunition being discharged through the barrel of the firearm.

An alternate object of the present invention is to provide an airsoft firearm system that is configured to provide information to a user wherein the firearm of the present invention further includes a motion sensor wherein the motion sensor includes level detection and is utilized to calculate draw time.

Still a further object of the present invention is to provide a firearm system that is configured to provide operational monitoring during use of the firearm wherein the firearm of the present invention includes a safety module wherein the safety module is configured to inhibit operation of the firearm.

An additional object of the present invention is to provide an airsoft firearm system that is configured to provide information to a user wherein the firearm that further includes an audio module wherein the audio module is configured to provide alternate sound effects.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
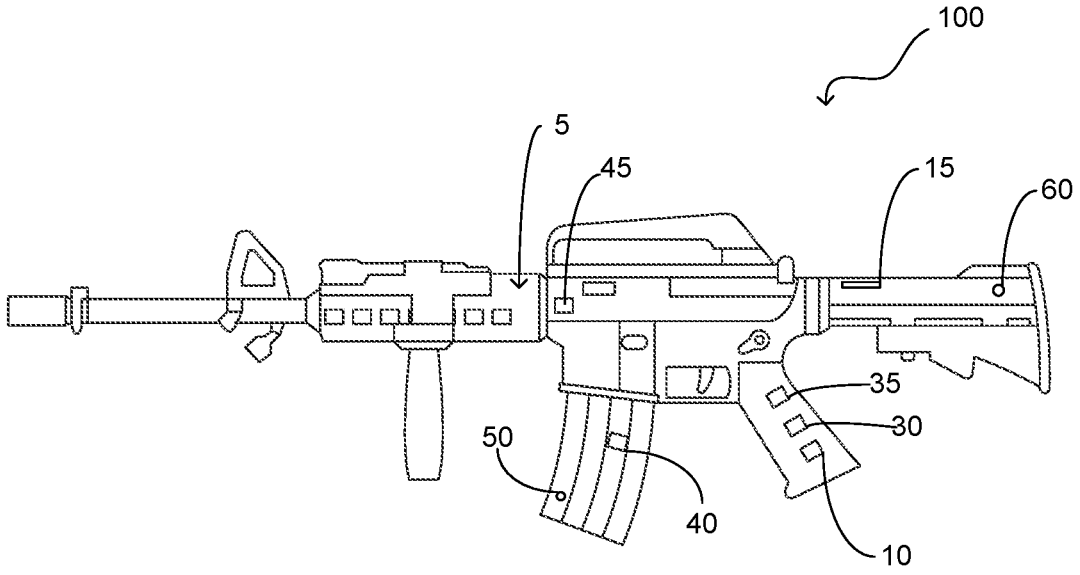
FIG. 1 is a side diagrammatic view of an embodiment of the present invention.
Figure 2:
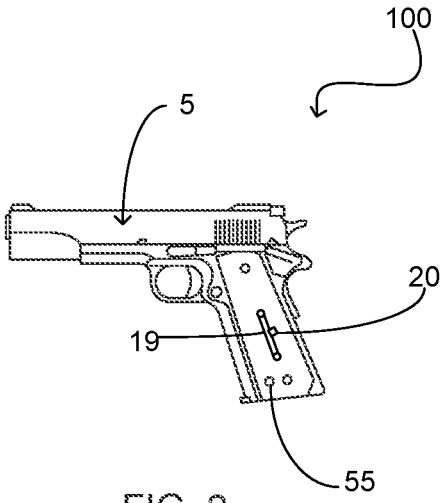
FIG. 2 is a side diagrammatic view of an alternative embodiment of the present invention.

Referring now to the drawings submitted herewith, wherein various elements depicted therein are not necessarily drawn to scale and wherein through the views and figures like elements are referenced with identical reference numerals, there is illustrated a firearm system 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the firearm system 100 is illustrated herein in two embodiments. It should be understood within the scope of the present invention that the embodiments of the firearm system 100 illustrated herein are exemplary and that various alternate styles of firearms could be employed. It should be further understood that the location of the modules discussed herein are illustrated in exemplary locations and could be located in various alternate locations on the firearm 5. The firearm system 100 includes a power supply 10 wherein the power supply 10 is configured to provide the necessary electrical power to the modules of the firearm system 100 that are further discussed herein. The power supply 10 is a conventional battery pack that is configured to receive batteries such as but not limited to lithium ion batteries.

The firearm system 100 further includes a communications module 15. The communications module 15 has the necessary electronic components to receive, store, manipulate and transmit data. The communications module 15 is configured to provide transmission of various operational parameter data to a remote computing device such as but not limited to a smart phone. The communications module 15 employs wireless protocols such as but not limited to Bluetooth in order to transmit data to a remote computing device. While not particularly illustrated herein, it should be understood within the scope of the present invention that a remote computing device operably coupled with the firearm system 100 includes a software application that provides a graphical interface to view the data transmitted by the communications module 15.

The firearm system 100 has a pressure sensor 20 operably coupled to a compressed gas power source 19. The compressed gas power source 19 is a conventional gas source such as but not limited to carbon dioxide cylinder. The pressure sensor 20 of the present invention is configured to monitor to pressure within the compressed gas power source 19 and transmit the pressure reading to the communications module 15. The communications module 15 transmits the pressure reading to a remote computing device so as to provide a user of the firearm system 100 with the amount of pressure remaining in the compressed gas power source 19.

A power monitor 30 is provided so as to monitor the level of power remaining in the power supply 10. The power monitor 30 is electrically coupled to the power supply 10 and is further operably coupled to the communications module 15 so as to provide transmission of the power available in the power supply 10. A safety module 35 is operably coupled to the power supply 10 and communications module 15. The safety module 35 is configured to provide the ability to inhibit operation of the firearm 5 through disablement of the power supply 10. The safety module 35 is activated utilizing the remote computing device wherein a security feature such as but not limited to a password is required in order for the safety module 35 to place the firearm 5 in active status. It should be understood within the scope of the present invention that the safety module 35 could be configured in alternate manners in order to inhibit the operation of the firearm 5.

The firearm system 100 further includes an ammunition counting module 40. The ammunition counting module 40 is operably coupled with an ammunition chamber. As the preferred embodiment of the present invention is an airsoft gun, the airsoft gun is configured to shoot round non-metallic projectiles. These projectiles are typically deposited into an ammunition chamber wherein a conventional ammunition chamber may hold hundred of projectiles. During use of the firearm 5, a user is unable to visually inspect the ammunition chamber and as such cannot determine the quantity of ammunition remaining. The ammunition counting module 40 of the present invention is configured to provide detection of passing projectiles and further monitor the volume of the ammunition chamber. For the latter, infrared sensors are disposed within the interior volume of the ammunition chamber so as to detect the amount of empty space therein. Detection of the empty space of the ammunition chamber in conjunction with the counting of projectiles as they are transferred from the ammunition chamber to the barrel provides the ability to determine the amount of remaining ammunition. The ammunition counting module 40 transfers the data to the communications module 15 wherein the user is provided both a firing consumption rate as well as the amount of remaining ammunition.

The firearm system 100 further includes a first location sensor 45 and a second location sensor 50. The first location sensor 45 and second location sensor 50 are operably coupled to the communications module 15. The first location sensor 45 is mounted to the body of the firearm 5 and the second location sensor is mounted to a removable accessory such as but not limited to a magazine. The first location sensor 45 can be utilized to identify the location of either the firearm and/or a user. Utilizing the software application operably coupled to the communications module 15, the first location sensor 45 can be employed to identify and track a user during a particular training exercise. The second location sensor 50 can be used as described for the first location sensor but can also be utilized to locate an accessory that may have been dropped during use of the firearm system 100. It should be understood within the scope of the present invention that the first location sensor 45 and second location sensor 50 employ GPS technology in a preferred embodiment.

The firearm system 100 further includes a position sensor 55. The position sensor 55 is configured to detect the orientation of the firearm 5. Position sensor 55 is operably coupled to the communications module 15. The position sensor 55 employs ball switches or similar technology to determine when the firearm 5 is oriented with the barrel pointed downward and further determine when the firearm 5 is oriented with the barrel oriented in a level position. In one use of monitoring for the two aforementioned positions, the time between the transition between the two orientations can be utilized to record the draw time of a user. This data is transmitted to the remote computing device via the communications module 15 and can be used in training exercises.

An audio module 60 is present on the firearm system 100. The audio module 60 is operable to provide various sound effects during use of the firearm system 100. The audio module 60 is operably coupled to the communications module 15 wherein the communications module 15 receives data from the remote computing device for broadcasting of audio sound effects. The audio module 60 includes at least one speaker and it is contemplated within the scope of the present invention that a plurality of sound effects could be broadcast therefrom.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the claims.

What is claimed is:

1. A firearm system configured to provide operational parameter data to a user during use of a firearm wherein the firearm system comprises:

a firearm;

a communications module, said communications module having electronics configured to receive, store, transmit and manipulate data, said communications module operable to transmit operational parameter data of the firearm to a remote computing device;

a power supply, said power supply being mounted within the firearm, said power supply configured to provide power to the firearm system;

a power monitor module, said power monitor module operably coupled to said power supply and said communications module, said power monitor module configured to measure a level of power within the power supply and transmit to said communications module; and an ammunition counting module, said ammunition counting module operably coupled to an ammunition chamber of the firearm, said ammunition counting module having at least one sensor configured to measure a quantity of ammunition stored within the ammunition chamber, said ammunition counting module being communicably coupled to said communications module, and a pressure sensor, said pressure sensor being operably coupled to said communications module, said pressure sensor being operably coupled with a pressurized gas source disposed within the firearm.

2. The firearm system as recited in claim 1, and further including a first location sensor, said first location sensor being secured to the firearm, said first location sensor being configured to provide a geolocation of the firearm.

3. The firearm system as recited in claim 2, and further including a position sensor, said position sensor configured to determine a first and second orientation of the firearm, wherein in the first orientation the firearm has a barrel thereof oriented towards a ground surface and in the second orientation the barrel of the firearm is in a level orientation.

4. The firearm system as recited in claim 3, and further including a safety module, said safety module operably coupled to the power supply, said safety module configured to provide activation of the power supply.

5. The firearm system as recited in claim 4, and further including a second location sensor, said second location sensor being secured to a removable component of the firearm, said second location sensor being configured to provide a geolocation of the removable component of the firearm.

6. The firearm system as recited in claim 5, and further including an audio module, said audio module operably coupled to said communications module, said audio module configured to broadcast sound effects during use of the firearm.

7. An airsoft firearm system comprising:

a firearm;

a communications module, said communications module having electronics configured to receive, store, transmit and manipulate data, said communications module operable to transmit operational parameter data of the firearm to a remote computing device;

a power supply, said power supply being mounted within the firearm, said power supply configured to provide power to the firearm system;

a power monitor module, said power monitor module operably coupled to said power supply and said communications module, said power monitor module configured to measure a level of power within the power supply and transmit to said communications module;

a position sensor, said position sensor configured to determine a first and second orientation of the firearm, wherein in the first orientation the firearm has a barrel thereof oriented towards a ground surface and in the second orientation the barrel of the firearm is in a substantially level orientation;

an ammunition counting module, said ammunition counting module operably coupled to an ammunition chamber of the firearm, said ammunition counting module having a plurality of sensors wherein one of said plurality of sensors is configured to measure a quantity of ammunition stored within an interior volume of the ammunition chamber, said ammunition counting module being communicably coupled to said communications module; and an audio module, said audio module operably coupled to said communications module, said audio module configured to broadcast sound effects during use of the firearm.

8. The airsoft firearm system as recited in claim 7, wherein one of said plurality of sensors of said ammunition counting module is configured to provide a quantity of ammunition removed from the ammunition chamber and discharged from the firearm.

9. The airsoft firearm system as recited in claim 8, and further including a first location sensor, said first location sensor being secured to the firearm, said first location sensor being configured to provide a geolocation of the firearm.

10. The airsoft firearm system as recited in claim 9, and further including a second location sensor, said second location sensor being secured to a removable component of the firearm, said second location sensor being configured to provide a geolocation of the removable component of the firearm.

11. The airsoft firearm system as recited in claim 10, and further including a pressure sensor, said pressure sensor being operably coupled to said communications module, said pressure sensor being operably coupled with a pressurized gas source disposed within the firearm, said pressure sensor configured to measure a remaining gas amount in the pressurized gas source and transmit to said communications module.

12. The airsoft firearm system as recited in claim 11, wherein said first location sensor facilitates an ability to track a geolocation of a user of the firearm.

13. An airsoft firearm system configured to provide operational parameter data to a user during use of the airsoft firearm system wherein the airsoft firearm system comprises:

a firearm;

a communications module, said communications module having electronics configured to receive, store, transmit and manipulate data, said communications module operable to transmit operational parameter data of the firearm to a remote computing device;

a power supply, said power supply being mounted within the firearm, said power supply configured to provide power to the firearm system;

a power monitor module, said power monitor module operably coupled to said power supply and said communications module, said power monitor module configured to measure a level of power within the power supply and transmit to said communications module;

a position sensor, said position sensor configured to determine a first and second orientation of the firearm, wherein in the first orientation the firearm has a barrel thereof oriented towards a ground surface and in the second orientation the barrel of the firearm is in a substantially level orientation;

a first location sensor, said first location sensor being secured to the firearm, said first location sensor being configured to provide a geolocation of the firearm' a second location sensor, said second location sensor being secured to a removable component of the firearm, said second location sensor being configured to provide a geolocation of the removable component of the firearm;

an ammunition counting module, said ammunition counting module operably coupled to an ammunition chamber of the firearm, said ammunition counting module having a plurality of sensors wherein one of said plurality of sensors is configured to measure a quantity of ammunition stored within an interior volume of the ammunition chamber, said ammunition counting module being communicably coupled to said communications module;

an audio module, said audio module operably coupled to said communications module, said audio module configured to broadcast sound effects during use of the firearm; and a pressure sensor, said pressure sensor being operably coupled to said communications module, said pressure sensor being operably coupled with a pressurized gas source disposed within the firearm, said pressure sensor configured to measure a remaining gas amount in the pressurized gas source and transmit to said communications module.

14. The airsoft firearm system as recited in claim 13, wherein one of said plurality of sensors of said ammunition counting module is configured to provide a quantity of ammunition removed from the ammunition chamber and discharged from the firearm.

* * * * *